US008546713B2

(12) United States Patent
Huang

(10) Patent No.: US 8,546,713 B2
(45) Date of Patent: Oct. 1, 2013

(54) PUSH BUTTON STRUCTURE WITH CURVED LEVER

(75) Inventor: Cheng-Chun Huang, Taipei (TW)

(73) Assignee: D-Link Corporation, Taipei (TW)

( * ) Notice: Subject to any disclaimer, the term of this patent is extended or adjusted under 35 U.S.C. 154(b) by 239 days.

(21) Appl. No.: 13/067,044

(22) Filed: May 4, 2011

(65) Prior Publication Data

US 2012/0234659 A1 Sep. 20, 2012

(30) Foreign Application Priority Data

Mar. 15, 2011 (TW) ..... 100204539 U

(51) Int. Cl.
*H01H 13/00* (2006.01)

(52) U.S. Cl.
USPC ..... 200/343; 200/341; 200/345; 200/335

(58) Field of Classification Search
USPC ..... 200/341
See application file for complete search history.

(56) References Cited

U.S. PATENT DOCUMENTS

| | | | | |
|---|---|---|---|---|
| 5,241,145 | A * | 8/1993 | Kawade | 200/530 |
| 5,481,074 | A * | 1/1996 | English | 200/5 A |
| 5,569,889 | A * | 10/1996 | Bruner | 200/5 A |
| 6,355,890 | B1 * | 3/2002 | Kuroda | 200/5 A |
| 7,795,554 | B2 * | 9/2010 | Kim | 200/552 |
| 2009/0200147 | A1 * | 8/2009 | Watanabe | 200/406 |

* cited by examiner

*Primary Examiner* — Renee Luebke
*Assistant Examiner* — Ahmed Saeed
(74) *Attorney, Agent, or Firm* — Bacon & Thomas, PLLC

(57) ABSTRACT

A push button structure includes a casing and a button body that are integrally formed by injection molding. The casing has an opening that extends through the surface of the casing. The button body is formed within the opening, and has an outer periphery spaced from the inner periphery of the opening and has an outer surface exposed on the surface of the casing and an inner surface extended by the curved lever. The curved lever has one end fixedly connected to an inner wall of the casing at a position adjacent to the opening such that the button body is movably positioned inside the opening. When the button body is pressed, the elasticity of the curved lever allows the button body to move toward the inside of the casing and thereby trigger an electronic switch in the casing.

7 Claims, 3 Drawing Sheets

PUSH BUTTON STRUCTURE WITH CURVED LEVER

FIELD OF THE INVENTION

The present invention relates to a push button structure, more particularly to a push button structure with a curved lever, so as to allow a user who presses a button body of the push button structure to have a clear feel of the movement of the button body and also enhance the durability of the push button structure as well as solving the problem of uneven formation of the push button structure existing in the prior art during an injection molding process.

BACKGROUND OF THE INVENTION

With the rapid development of technology, various electronic devices have become indispensable tools in our daily lives and work. These electronic devices provide assistance in a good number of fields such as information transfer, business transaction, interpersonal communication, document preparation, and computer graphics, so as to enable better and faster completion of certain tasks. Typically, the casing of such an electronic device is provided with a push button structure which can be pressed by the user to start the electronic device or activate different functions thereof. The conventional push button structures are made by an injection molding process in which a specific amount of molten plastic is injected under high pressure into a mold and, once the molten plastic is cooled and cured, a casing with a push button structure is formed and ready to be installed on the intended electronic device.

FIG. 1 shows a push button structure 1 that is used in most of the electronic devices nowadays. The push button structure 1 includes a casing 10 and a button body 12. The casing 10 has a surface provided with an opening 101, wherein the opening 101 extends through the surface. The button body 12 is formed in the opening 101 and has an outer periphery spaced from the inner periphery of the opening 101. A straight lever 121 extending from one end of the button body 12 has one end connected to the inner periphery of the opening 101 such that the button body 12 is movably positioned within the opening 101. When the button body 12 is pressed, the lever 121 is also subjected to the pressing force. As a result, the end of the lever 121 that is adjacent to the button body 12 is deformed, allowing the button body 12 to move inward of the casing 10 and trigger an electronic switch in the electronic device. Once the pressing force is removed, the lever 121 resiliently resumes its original position and brings the button body 12 back to its original position, too. Thus, by significant displacement of the button body 12 when pressed, the electronic switch is triggered to activate or deactivate the corresponding function (s) of the electronic device. However, the push button structure 1 has the following drawbacks:

(1) Limitation in lever thickness: As the push button structure 1 depends on deformation of the lever 121 to enable movement of the button body 12 and thereby trigger the electronic switch, the lever 121 must not be too thick, or the elasticity of the lever 121 will be reduced, which prevents the deformation required for the button body 12 to be pressed against and trigger the electronic switch. In other words, an excessively thick lever 121 will lower the sensitivity of the push button structure 1. Therefore, while designing the push button structure 1, the thickness of the lever 121 must be controlled to ensure smooth operation of the push button structure 1.

(2) Limitation in lever length: Now that the lever 121 has its limitation in thickness as stated in the previous paragraph, the lever 121 must also not be too long; otherwise, when subjected to an undue pressing force, the end of the lever 121 that is adjacent to the button body 12 may bend at such a large angle (e.g., 30~50 degrees) that the lever 121 is overloaded and breaks, thereby compromising the durability of the push button structure 1. Further, if the lever 12 is too long, the gap between the outer periphery of the button body 12 and the inner periphery of the opening 101 will be large and unsightly, and the lever 12 can be so floppy that the button body 12 is readily moved by the user's unintentional actions and thus triggers the electronic switch by accident, which is very inconvenient. In addition, if the lever 12 is too long, the button body 12 may tilt to one side when pressed and gives the user only a vague feel of its being pressed.

(3) Low yield rate: During the injection molding process of the push button structure 1, the cross section of the lever 121—which is under the aforementioned design limitations—tends to reduce the injection speed of molten plastic and therefore result in defects or a sink mark on button surface of the button body 12. In consequence, not only is the yield rate low, but also the production cost is increased.

To overcome the foregoing drawbacks, another kind of push button structure as shown in FIG. 2 was developed. The push button structure 2 in FIG. 2 includes a casing 21 and a button body 22. The casing 21 is provided with an opening 210 and a post 211 adjacent to the opening 210. The button body 22 has a hole 221 at one end and a pressing portion 223 at the other end, wherein the pressing portion 223 extends from one side of the button body 22. The other side of the button body 22 is protrudingly provided with a projection 225. The hole 221 is mounted around the post 211 and is fixed to the casing 21 at a position adjacent to the opening 210 by gluing or other fastening means. The pressing portion 223 corresponds in shape to the opening 210 and is received therein. When pressed, the pressing portion 223 is moved inward of the casing 21 about a fulcrum defined by the hole 221, thanks to elasticity of the button body 22, thus allowing the projection 225 to trigger an electronic switch 23 in the casing 21. As the button body 22 of the push button structure 2 is not integrally formed with the casing 21, the injection molding process of the button body 22 is safe from uneven injection of molten plastic. In addition, by controlling the length of the button body 22, the portion of the button body 22 where the hole 221 is formed is prevented from excessive deformation when an overly large pressing force is applied to the pressing portion 223; therefore, the durability of the button body 22 is enhanced.

The push button structure 2, though free of the injection molding problem described above, has a far higher production cost than its integrally formed counterpart because the casing 21 and the button body 22 must be made separately. Besides, although the push button structure 2 is not subject to the aforesaid limitation in thickness, there is still length limitation on the button body 22, for if the button body 22 is too short, the portion of the button body 22 where the hole 221 is located may break when deformed beyond a certain limit. Thus, the push button structure 2 still leaves much to be desired in terms of improving the conventional push button structures. Accordingly, the issue to be addressed by the present invention is to design a push button structure which is integrally formed to lower production costs, which prevents uneven injection of material in the injection molding process, and which, when pressed, gives the user a clear feel of being so.

BRIEF SUMMARY OF THE INVENTION

In view of the drawbacks of the conventional push button structures, the inventor of the present invention conducted extensive research and tests and finally succeeded in developing a push button structure with a curved lever as disclosed herein. The disclosed push button structure is intended to prevent uneven injection of molten plastic during the injection molding process so as to increase yield rate. It is also intended that the disclosed push button structure, when pressed, gives the user a clear feel of its being pressed.

It is an object of the present invention to provide a push button structure with a curved lever, wherein the push button structure includes a casing and a button body that are integrally formed by injection molding. The casing has an opening that extends through the surface of the casing. The button body is formed within the opening and has an outer periphery spaced from the inner periphery of the opening. In addition, the button body has an outer surface exposed on the surface of the casing and an inner surface extended by the curved lever, wherein the curved lever has a U-shaped, V-shaped, or other curved cross section. The curved lever has one end fixedly connected to an inner wall of the casing at a position adjacent to the opening such that the button body is movably positioned inside the opening. When the outer surface of the button body is pressed, the elasticity of the curved lever allows the button body to move toward the inside of the casing and thereby trigger an electronic switch in the casing. Once the pressing force is removed, the button body returns to its original position due to the elasticity of the curved lever. As the curved lever has a relatively long displacement path and relatively high elasticity, the user pressing the button body will have a clear feel of the button body's being pressed. Thus, incorrect operations of the push button structure (e.g., failure to trigger the electronic switch and triggering the electronic switch by accident) are prevented. Furthermore, due to its curved configuration, the curved lever can have its length and thickness easily adjusted to form the desired displacement path and produce the desired elasticity, so as for the button body, when pressed, to give a clear feel of its being so, thereby meeting the needs of most users. Moreover, the end of the curved lever that is adjacent to the button body will not bend at a large angle (e.g., 30~50 degrees) when subjected to a pressing force; hence, the curved lever not only can sustain a relatively large pressing force, but also can be reasonably elastic even with an increased thickness. The curved lever is effective is enhancing the durability of the push button structure as well as solving the problem of uneven formation of the push button structure during the injection molding process.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

Figure 3:
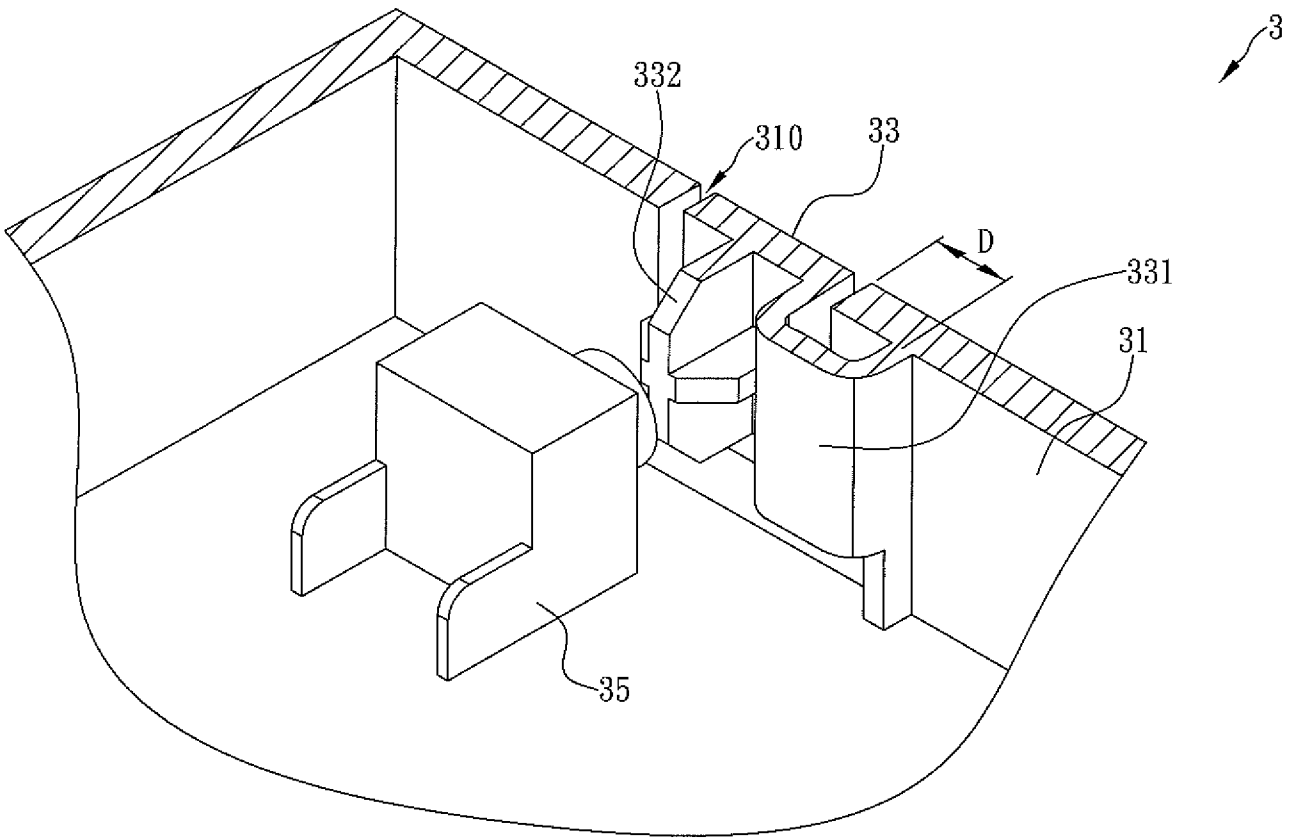
FIG. 3 is a perspective view of a push button structure with a curved lever according to the present invention.

The present invention provides a push button structure with a curved lever. Referring to FIG. 3 for a preferred embodiment of the present invention, the push button structure 3 is applied to an electronic device (not shown) and includes a casing 31 and a button body 33. The casing 31 and the button body 33 are formed as a single unit by injection molding. In order to facilitate understanding of the technical features of the present invention, the upper right corner of FIG. 3 is defined as the outside of the casing 31 (and hence of the electronic device), and the lower left corner of FIG. 3 as the inside of the casing 31 (and hence of the electronic device).

As shown in FIG. 3, the casing 31 has an opening 310 that extends through the surface of the casing 31. The button body 33 corresponds in shape to the opening 310 and is formed within the opening 310. The outer surface of the button body 33 is exposed on the surface of the casing 31 so as to be pressed by the user. The inner surface of the button body 33 is extended by a curved lever 331 having a U-shaped, V-shaped, or other curved cross section, wherein the curved lever 331 has one end fixedly connected to an inner wall of the casing 31 at a position adjacent to the opening 310, and the end of the curved lever 331 is separated from the opening 310 by a distance D. The outer periphery of the button body 33 is spaced from the inner periphery of the opening 310 such that the button body 33 is movably positioned within the opening 310. When the outer surface of the button body 33 is pressed, the pressing force is transferred to the curved lever 331. As a result, the end of the curved lever 331 that is adjacent to the button body 33 is moved away from the opening 310, and the curved lever 331 is deformed, thereby allowing the button body 33 to move toward the inside of the casing 31, and the inner surface of the button body 33 to press against and trigger an electronic switch 35 in the electronic device. Once the pressing force is removed, owing to the elasticity of the curved lever 331, the end of the curved lever 331 that is adjacent to the button body 33 displaces toward the opening 310 and causes the button body 33 to resume its original position. It should be noted that, in order for a person skilled in the art to clearly understand the technical features of the present invention, a lever having a U-shaped cross section is illustrated in the preferred embodiment of FIG. 3 to demonstrate the structure, connection, and operation of the curved lever 331; however, implementation of the present invention is not limited thereto. The curved lever 331 may have a V-shaped or other curved cross section, provided that the curved lever 331 has one end fixed to the inner surface of the button body 33 and the other end fixedly connected to the inner wall of the casing 31 at a position adjacent to the opening 310.

As the curved lever 331 has a relatively long displacement path and relatively high elasticity, the gap between the outer periphery of the button body 33 and the inner periphery of the opening 310 can be as small as possible to significantly improve the overall esthetics of the casing 31 and the button body 33 on the electronic device. The relatively long displacement path and relatively high elasticity of the curved lever 331 also allow marked displacement of the button body 33 and prevent the button body 33 from tilting toward one side. Thus, the button body 33 can give the user who is pressing it an unambiguous feel of its being pressed, will not cause accidental triggering of the electronic switch 35 which may otherwise occur if the button body 33 is displaced inward by an unintentional action of the user, and will not fail to trigger the electronic switch 35 when the button body 33 is pressed. In short, the push button structure 3 functions with enhanced accuracy.

Figure 1:
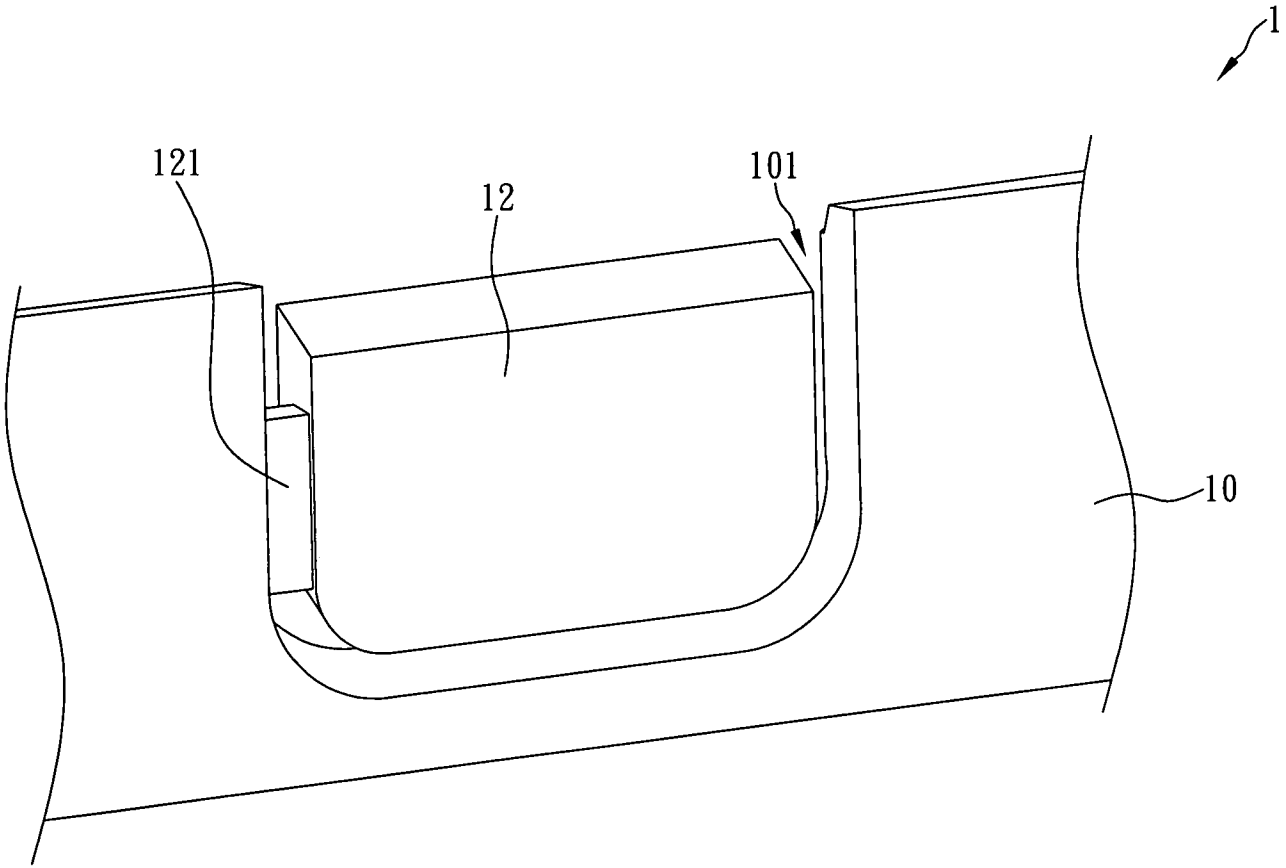
FIG. 1 (Prior Art)
FIG. 1 is a perspective view of a conventional push button structure.
Figure 2:
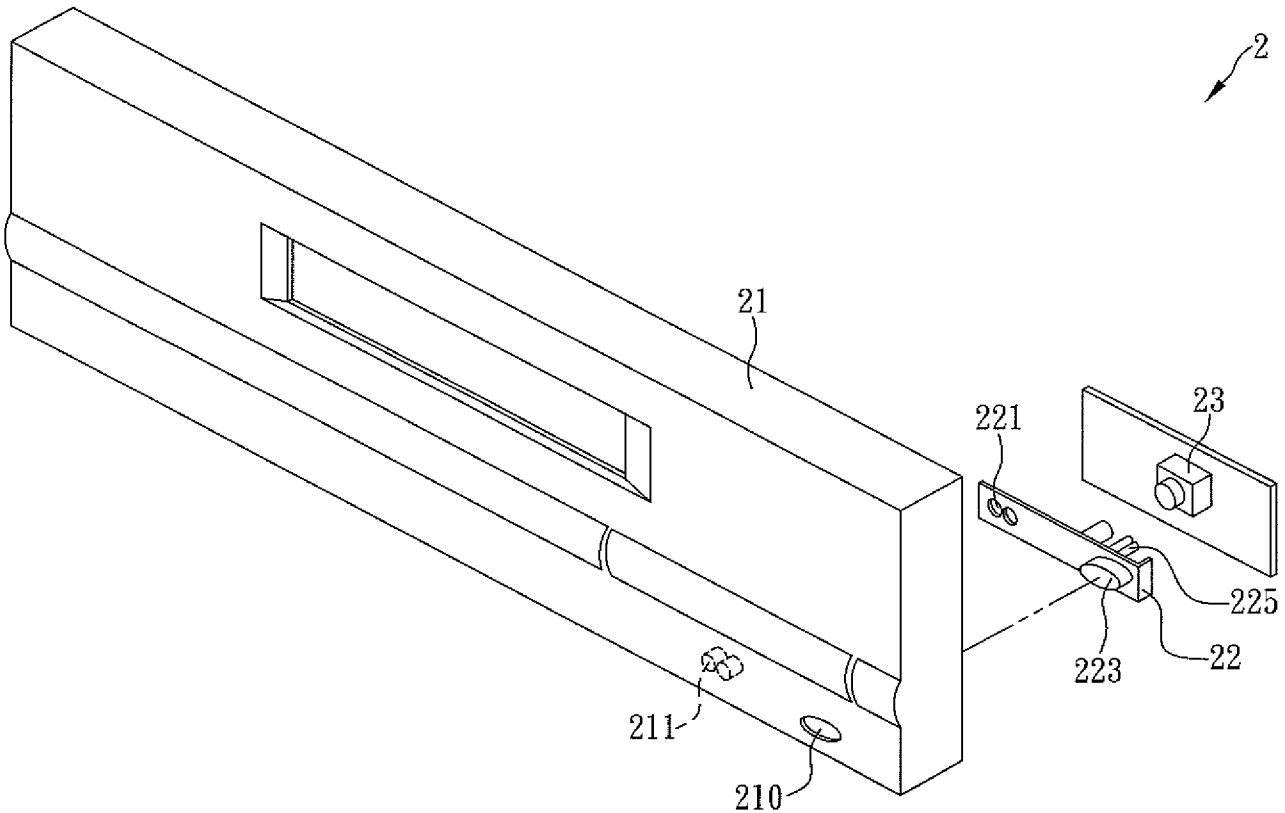
FIG. 2 (Prior Art)
FIG. 2 is an exploded perspective view of another conventional push button structure.

Referring to FIG. 3 in conjunction with FIG. 1, the disclosed push button structure 3 with the curved lever 331 further has the following advantages that are unachievable by the conventional push button structure 1.

(1) Capability to withstand a relatively strong pressing force: When a pressing force is applied to the straight lever 121 of the conventional push button structure 1, the end of the lever 121 that is adjacent to the button body 12 is displaced away from the opening 101. However, with the other end of the lever 121 being fixed at the inner periphery of the opening 101, if the end of the lever 121 that is adjacent to the button body 12 is bent at an excessively large angle (e.g., 30~50 degrees), the lever 121 is very likely to be overloaded and break as a result. By contrast, the curved lever 331 of the push button structure 3 disclosed herein has a curved configuration, and the end of the curved lever 331 that is adjacent to the button body 33 is fixed at the inner surface of the button body 33. Therefore, compared with the conventional lever 121, whose end adjacent to the button body 12 deforms significantly when subjected to a pressing force, the curved lever 331 has a different overall behavior when the button body 33 is pressed. More specifically, the pressing force and the bending angle are evenly distributed over the middle section of the curved lever 331 and the end of the curved lever 331 that is adjacent to the casing 31 to prevent the curved lever 331 from damage which may otherwise result from excessive deformation of a certain part of the curved lever 331. Therefore, the durability of the push button structure 3 is substantially increased.

(2) Less limitations in design specifications: Since the curved lever 331 does not deform as drastically as the conventional lever 121 when pressed, the thickness and length of the curved lever 331 can be adjusted as appropriate to provide the curved lever 331 with adequate elasticity and durability. Apart from that, the cross section of the curved lever 331 can be so designed that it is far larger than the cross section of the conventional lever 121, with a view to preventing the injection speed of molten plastic from being affected during the injection molding process. This allows the button body 33 to be evenly formed and ensures high yield rate of the push button structure 3.

Referring again to FIG. 3, in the present preferred embodiment, the inner surface of the button body 33 is protrudingly provided with a projection 332. One end of the projection 332 extends to a position adjacent to the electronic switch 35 so that, when the outer surface of the button body 33 is pressed to displace the button body 33 toward the inside of the casing 31, the projection 332 on the button body 33 is pressed precisely against the electronic switch 35 to trigger the electronic switch 35 and thereby activate the corresponding function(s) of the electronic device.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures

What is claimed is:

1. A push button structure with a curved lever, comprising:

a casing having a surface formed with an opening, wherein the opening extends through the surface; and a button body integrally formed with the casing by injection molding, being formed within the opening, and having an outer surface and an inner surface, wherein the outer surface is exposed on the surface of the casing so as to be pressed, and the button body has an outer periphery spaced from an inner periphery of the opening such that the button body is movably positioned within the opening; and the curved lever provided on the inner surface of the button body and extending inward of the casing, wherein the curved lever has an end fixedly connected to an inner wall of the casing at a position adjacent to the opening, and the end of the curved lever is separated from the opening by a distance;

thereby, when the outer surface of the button body is pressed, the button body is displaced inward of the casing due to elasticity of the curved lever, and is then triggering an electronic switch in the casing, and when the outer surface of the button body is no longer pressed, the button body resumes an original position thereof due to the elasticity of the curved lever.

2. The push button structure of claim 1, wherein the inner surface of the button body is protrudingly provided with a projection, the projection having an end extending to a position adjacent to the electronic switch so that, when the outer surface of the button body is pressed, the end of the projection is pressed against the electronic switch to trigger the electronic switch.

3. The push button structure of claim 2, wherein the curved lever has a U-shaped cross section.

4. The push button structure of claim 2, wherein the curved lever has a V-shaped cross section.

5. A push button structure, comprising:

a casing for containing a switch and defining an inner wall and an outer wall, and having an opening extending through the inner and outer walls;

a button body located within the opening and defining an inner surface and an outer surface, and having a projection protruding from the inner surface for pressing against the switch contained inside the casing, wherein the button body is integrally formed with the casing by injection molding; and a curved lever having a first end integrally connected to the inner wall of the casing at a location spaced apart from the opening by a distance, and a second end integrally connected to the button body for movably positioning the button body within the opening, such that the first end of the curved lever extends from the inner wall in a direction toward the inside of the casing and the second end of the curved lever extends from the inner surface of the button body in a direction toward the inside of the casing, wherein the curved lever is deformable so that pressing the outer surface of the button body displaces the button body toward the inside of the casing.

6. The push button of claim 5, wherein the curved lever has a U-shaped cross section.

7. The push button of claim 5, wherein the curved lever has a V-shaped cross section.

* * * * *